US005392062A

United States Patent [19]

Ziemek

[11] Patent Number: 5,392,062

[45] Date of Patent: Feb. 21, 1995

[54] CONTINUOUSLY MARKING ELONGATED STOCK

[75] Inventor: Gerhard Ziemek, Langenhagen, Germany

[73] Assignee: Kabelmetall Electro GmbH, Hanover, Germany

[21] Appl. No.: 822,625

[22] Filed: Jan. 17, 1992

[30] Foreign Application Priority Data

Feb. 9, 1991 [DE] Germany ..... 4104039

[51] Int. Cl.[6] ..... B41J 2/02

[52] U.S. Cl. ..... 347/4; 347/73

[58] Field of Search ..... 347/2, 4, 20, 44, 47, 347/73, 75, 101

[56] References Cited

U.S. PATENT DOCUMENTS 3,063,050 11/1962 Millis ..... 347/101 Y 4,160,426 7/1979 Lambelet ..... 347/101 Y

*Primary Examiner*—Joan H. Pendegrass

[57] ABSTRACT

An apparatus for the continuous marking of elongated stock moving in the direction of extension of the stock and including one or more nozzles for directing a dye-jet towards the elongated stock is improved by causing the nozzles to oscillate in a plane parallel to the direction of movement of the elongated stock to be marked; and the jets as produced by flows in the respective nozzle along the plane of oscillation and are redirected to emerge at right angles to the plane of oscillation; the nozzles either include a first duct extending in the nozzle body in a particular direction and being continued in a second duct extending at 90 degrees; alternatively a nozzle is a tube of L-shaped configuration.

6 Claims, 1 Drawing Sheet

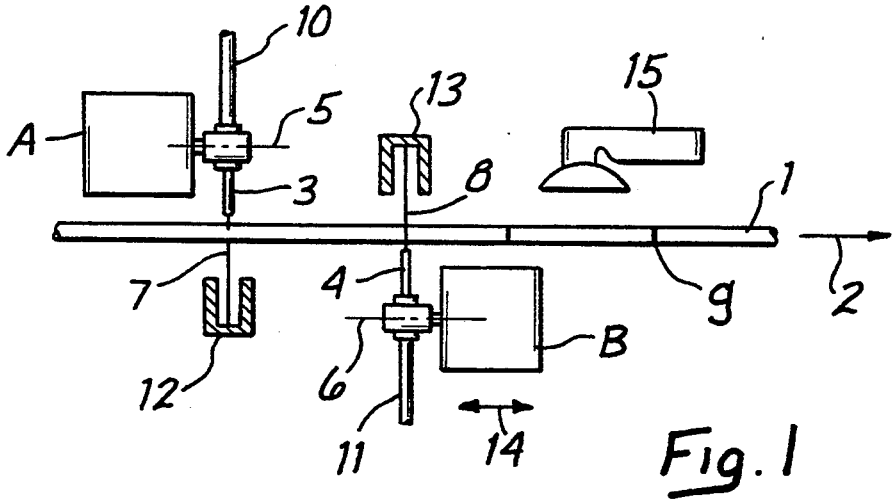
Fig. 1
Fig. 2
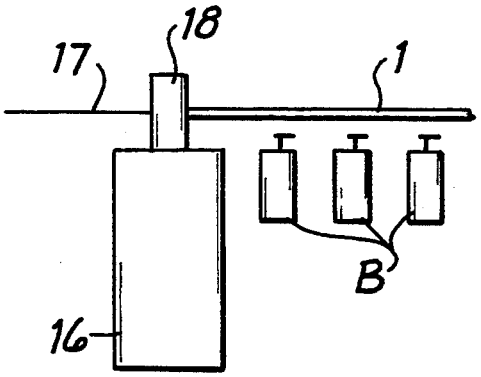
Fig. 3
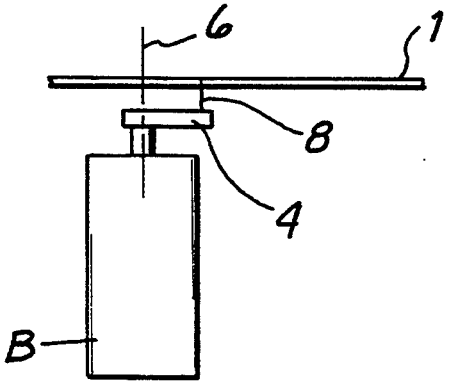
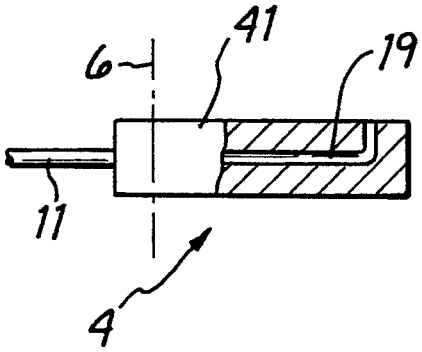
Fig. 4
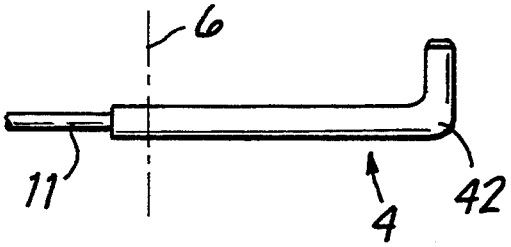
Fig. 5

CONTINUOUSLY MARKING ELONGATED STOCK

BACKGROUND OF THE INVENTION

The present invention relates to a method for the continuous marking of elongated stock which is moved predominantly in the direction of the physical extension of that stock, that is, the longitudinal extension; and more particularly, the invention relates to markings on the surface of such moving elongated stock, the markings having limited axial extensions and being produced under utilization of one or more dye-jets. The dye is forced in each instance under pressure to emerge from a nozzle which oscillates; the dye-jet is oriented to impinge upon the stock at right angles or at least approximate right angles, to the direction of the stock. Equipment of this kind and to which the invention generally pertains is shown, for example, in German printed Patent Application 1,415,791.

In order to establish the scope of the invention, the term "elongated stock" is used as a general denotation referring, for example, to cores of metallic conductors with or without insulation on top; also included are light-wave conductors and fiber optic conductors in the communications industry. But the term 'elongated stock' is not limited to cable and conductors of light and electricity, but also includes hoses or tubes for the conduction of liquid or fluid or electricity. Also included are bundles of any of the foregoing with or without jacket. Core strands of that kind being made for some purpose in a continuous fashion may require for some reason or another some kind of identification. For example individual conductors in a large bundle in which the individual conductors are twisted or stranded require individual identification.

In order to provide an adequate description of the invention, the rather cumbersome term "elongated stock" is avoided and the term "core" or "core strand" is used instead with the understanding that this is just an example of elongated stock and is in that respect simply representative of the more general term "elongated stock". Cores or core strands are, for example, used in communication cables wherein identification and marking is necessary in order to establish a clear identification of individual core elements or cores among a large plurality of physically similar cores, but being bundled, intertwined, and so forth, so that any indentification without marking is difficult or even impossible. Therefore, individual cores in a bundle require identification and it is part of the invention to establish adequate provisions for that purpose. In a more or less simple fashion and by way of example, four cores are stranded together and three of them carry, for example, one, two and three colored bands respectively on their insulation these bands are organized in groups, and it really is the grouping pattern that identifies the three core strands, the fourth core being free, bearing no identifying band. The markings of cores may be established differently in that one of these cores carries bands or rings in a spaced apart relation; another one of the cores carries two bands close together and then there is a space followed by another group of two bands and so forth. The third core may also carry such twin rings but they are as a group spaced farther away than the twin rings of the second core just referred to and the forth core has no rings.

Another way of providing distinctive identification is to use single spaced apart bands but of different colors. It is clear that the way individual cores are identified can be varied to a great degree, but it is also clear that all of these markings require methods whereby the bands so provided firmly adhere to the surface of the cores and remain in place and recognizable even if the core is handled roughly, abrasively, or the like, because for example, stranding, winding, and unwinding, looping or other ways of handing the core require some surface gripping and engagement which inherently involve the possibility that any marking that does not firmly adhere to the surface is simply scratched or wiped away.

German Printed Patent Application 1,415,791 describes equipment for marking cores; the marking equipment is positioned immediately downstream from the extruder by means of which insulating material is deposited on a metallic conductor and within the terminology chosen here the metallic conductor with insulation is a core or core strand. The marking equipment includes a nozzle ejecting a dye-jet which will hit the still rather hot surface of the freshly-extruded insulating material. Owing to the fact that the insulation is still very hot, the dye marking will to some extent diffuse into the soft insulation (and that is highly desirable) and then will dry very quickly. Thus the dye will combine intimately with the insulating material of the core. This renders the dye abrasion-proof to a high degree.

A cooling path is provided downstream from the extruding and marking equipment. This cooling path serves additionally for drying the dye. The method as described in this prior art application is very advantageous in practice. Further improvements include equipment for oscillating the nozzle which ejects the dye-jet. All these pieces of equipment, including the driving aggregates for the oscillation as well as dye containers, are arranged in the immediate vicinity of the dye-jet-emitting head and are, moreover, positioned very close to the extrusion head by means of which insulation is provided on the conductor as stated. The dye-jet should impinge upon the core at right angles. Consequently the nozzle and its ejecting path, oscillating about an axis parallel to the core strand movement, is arranged at right angles to that axis.

The oscillating system of the prior art structure for but actually including the nozzle itself, however, was found to be rather large, bulky and heavy. Contributing to the largeness is the drive for the nozzle. It was found that these large dimensions of the nozzle-plus-drive system are troublesome because one may need two or more nozzles with oscillating systems if, for example, different colors are to be applied to the marking bands. Since, however, the insulating material of the core cools rapidly, the quality and adhesion of the sprayed-on markings deteriorates rapidly with distance from the extruder. In other words, if for example, three different colors are used, that is, if three different dyes have to be emitted from three different dye-spray (equipments) nozzles, one of them is necessarily positioned relatively far from the extruder, while one of them is fairly close. This means that the dye applied to the insulation fairly close to the extruder will adhere quite well to the insulation, but the dye applied by the spraying equipment farthest from the extruder will in fact have limited adhesability. Moreover, if for example, in a continuous manufacturing facility the markings are to be changed for one reason or another, the manufacturing actually has to be interrupted and the existing dye applying equipment or nozzles are exchanged for others, or the containers are exchanged to apply dyes of a different color, and any of these methods may be needed depending on the sophistication and differentiation of marking. Any such equipment change is of course a time consuming procedure and as far as core-cable-stock manufacture is concerned, it simply constitutes down time in which nothing is being produced.

DESCRIPTION OF THE INVENTION

It is an object of the present invention to improve the application of dye-markings on elongated stock, that is, cores and core strands as defined above, so that, for example, a change in band pattern and/or dye can be effected without or with limited down time.

It is another object of the present invention to provide a new and improved marking of elongated stock, that is, tube, cable, conductors, etc., identified representatively by cores and core strands, under conditions wherein a dye-jet nozzle, or several dye-jet nozzles, direct jets toward the core-stock; these nozzles oscillate on respective axes and are to be oriented in a manner such that the respective jet will impinge upon the core-stock at right angles as far as its elongated extension and the direction of movement is concerned.

In accordance with the preferred embodiment of the present invention, the objects are attained by providing an oscillating system for each nozzle to oscillate on a plane which extends parallel to the direction of movement of the core-stock. Moreover, the jet is oriented to emerge at right angles to the plane in which the nozzle oscillates. In other words, the method of the invention and the equipment needed for carrying out this method, are basically characterized by turning :the oscillating system 90 degrees from that of common practice. The oscillating system itself remains as has been practiced with advantage in the past. The nozzle, of course, oscillates around a particular axis, but it is essential that the nozzle oscillate parallel to the direction of movement of the stock to be marked and not at right angles thereto. The dye in the jet is thus deflected in the nozzle to hit the stock to be marked at right angles even though the oscillation obtains parallel to the direction of movement of the stock. As suggested here, one establishes the possibility of placing two or even more oscillating-nozzle systems in the immediate vicinity of the extrusion head for all of them to be in fact closely positioned to the extrusion, and to provide the different dyes when the surface of the freshly-extruded insulating material is still hot. This particular advantage results from the fact that the dimensions of the oscillating system in the direction of the respective axis are smaller than transversely thereto. Thus two or more such oscillating systems can be placed closer to each other owing to the reduced space requirement. The jet-dyes emerging from the respective nozzles will therefore always hit hot surfaces of the core strand to be marked simply because they are placed close to the extruder. The quality and adhesibility of the marking is thus considerably improved and is more or less so for all of the dyes of all of the different nozzle systems.

The foregoing establishes the considerable advantage that during a continuous manufacturing process, one can change methods of application of the respective band pattern and the nozzles themselves, without interruption of the manufacturing process. In particular, different kinds or colors of marking dyes can thereby be changed simply by having a plurality of oscillating systems, some on a stand-by basis and by switching from one to another. In other words, the particular arrangement here suggested permits the establishing of plural oscillating systems only some of which are used in any given period of time; if there is a change in dye or dye pattern one simply turns off one system and turns on one or more of the other systems which have not been working up to this point in time. Consequently there are no down times.

Any particular nozzle-oscillating system can be serviced whenever it is not used. Here one can clean the nozzle system, exchange parts, change the dye, or whatever. The overall production must be programmed, for example, so that certain dye-jet systems work during certain phases and others do not, which means that in terms of system, those which do not work at any point or in any given period of time, can be changed, modified, etc., during that period of time, to be subsequently available.

The exit-opening of arty of the nozzles is moved on a circle during oscillation, which means that the jet emerging from the nozzle moves on the surface of a cylinder whose center axis is the axis of oscillation. Consequently, the jet is moved along a curved surface. The curvature can be oriented in the direction of movement of the stock or in the opposite direction. This will depend on whether the dye-jet emerges in front of or behind the axis of the oscillating system whereby the terms "ahead" and "behind" are defined in relation to the direction of movement. Preferably, the dye-jet emerges from the nozzle behind or downstream from the axis of the oscillating system so that the dye in fact oscillates on a surface that is curved in the direction of movement. The dye-jet will thus obtain a component of motion which is effective in the direction of stock-core movement. The latter feature was found to improve the quality of the markings simply because the speed differential between the stock and the jet is reduced.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a schematic showing of an overall arrangement in accordance with the preferred embodiments of the present invention;

FIG. 2 is a schematic illustration of particular equipment for carrying out the method in accordance with the preferred embodiment of the present invention;

FIG. 3 is a schematic illustration of a detail and on an enlarged scale, of the structure shown of FIG. 2; and FIGS. 4 and 5 are details of structures and devices shown in FIG. 3 but in two different versions. The illustration is still on an enlarged scale compared with FIG. 3.

Proceeding now to the detailed description of the drawings, FIG. 1 illustrates a core strand 1; as an explanation and elucidation it is repeated that the term "core" is used here to identify elongated stock generally; in other words it may denote a wire, a cable, a bundle of wires and/or cable; the term 'core' may denote hollow, i.e. tubular stock, a bundle of tubes, etc.

That core 1 is moved in the direction of arrow 2 by means of a suitable extraction device that grips the core and pulls it through the equipment to be described next. This extraction device may be a moving equipment generally, a caterpillar device, or wheels, drums, etc.

Two oscillating systems A and B are provided for respectively oscillating rotationally about axes 5 and 6. These systems include nozzles 3 and 4 respectively and the nozzles move up and down and through the plane of the drawing of FIG. 1. The nozzle 3 provides a dye-jet 7 and the nozzle 4 provides a dye-jet 8, and these jets are generally directed towards the core strand 1 and at right angles with respect to the direction of movement of the core strand.

Markings are thus provided onto one side of the insulation of core 1 by the dye-jet 7 of system A; and owing to the oscillation the markings have the configuration of a half ring or band on core strand 1. That half ring in each instance is supplemented by the dye-jet 8 of the oscillating system B because the system B is on the other side of the strand 1 as far as system A is concerned.

The nozzles 3 and 4 are connected in each instance to a store for a particular dye and respectively through hoses or conduits 10 and 11. The containers for the dye are not shown but they are connected to the hoses 10, 11. Reference numerals 12 and 13 refer to dye capturing or catching shelves capturing the dye material that does not hit the core, this is in fact most of the material and the capture of these dye portions of the jets 7 and 8 is thus necessary for an economic practice, otherwise most of the dye would be wasted. This substantial amount of the dye is thus recycled to the respective storage facility for the dye. It should be mentioned that in most cases the dye will be of the same color to complete a mono-color band, but there is no inherent necessity for this; the two half bands could be of different color in which case two different dye stores and recycling systems are needed.

The oscillating system B can be shined as indicated by the twin arrows 14 in axial directions, i.e., along core 1. This adjustment permits mutual adjustment of jets 7 and 8 respectively of oscillating systems A and B so as to actually complement a continuous ring or band on core 1. A stroboscope 15 is provided as a measuring device to provide an active input to determine the coverage of the half-rings as far as the individual production is concerned. This feature makes sure that indeed a closed ring 4 is established during the production. Here, then, one envisions a rather high speed for core 1 in the direction of the arrow 2.

FIG. 1 merely illustrates the principle of function and operation of the invention but this implies a certain simplification, and a more complete conduction of the invention will be discussed in the following. For reasons of simplicity, reference is made to just one oscillating system, for example, the oscillating System B, but all descriptive elements presented here must be understood to refer to system A as well and, possibly, to other systems of a comparable nature as well.

FIG. 2 illustrates a structure for carrying out the method in accordance with the invention. Here, then, an extruder 16 provides an electrically and/or thermally insulating coating onto element 17 of core 1. This element 17 may be an electrical conductor or wire, etc. For this purpose, conductor 17 is run through extrusion head 18 of extruder 16. In accordance with FIG. 2, moreover, three oscillating systems B are arranged along core I in the immediate vicinity of extruder 16 and its head 18. From a general point of view, there should be at least two oscillating systems. All the oscillating systems may be very closely positioned in relation to each other because, as compared with FIG. 2, they are offset by 90 degrees; their axes 6 are 90° offset as can be seen from FIG. 3 showing one of the three systems of FIG. 2.

The principal dimension of measurement of each oscillating system is such that it extends transversely to the direction of movement of core 1. This dimensional positioning establishes a plane in which all of nozzles 4 oscillate. More accurately one should speak of a set of parallelly positioned planes of oscillation which do extend parallelly to the longitudinal extension and movement of core 1. However this is the general case, the planes of oscillation of the several nozzles may completely or nearly coincide. It follows from this particular orientation of the oscillating equipment that the jets 8 have to be deflected in the direction towards the core 1. In order to provide that deflection of dye-jet 8, the nozzles are particularly constructed.

FIG. 4 and 5 show nozzle configurations and constructions that meet the requirements. In FIG. 4 nozzle body 40 is provided with a channel 19. This channel 19 has a contour and extension within the nozzle body to provide a 90 degree deflection of the passing—through dye flow. The dye-jet thus emerges laterally from the nozzle 4. It is apparent that the foregoing is also applicable to nozzle 4 corresponding to FIG. 5. Here a tubular nozzle 42 is shown which, at its free end, is turned 90 degrees. Dye-jet 8 also emerges at a right angle and towards core strand 1. In all these cases it is assumed that the nozzle body oscillates on a curved surface such that the resulting jet impinges at rights angles upon core 1.

Since dye-jet 8 emerges from nozzle 4 under pressure, it obtains a velocity component which is effective in the direction of arrow 2, that is, in the direction of withdrawal of core 1 as shown in FIGS. 2 and 3. Consequently the dye-jet is curved in the direction of withdrawal. This in turn results in a supplemental speed component that is imparted in an absolute sense upon dye-jet 8. It was found that even though this speed component is fairly small, it provides a significant improvement in the quality of the dye-marking on core 1.

FIGS. 2 an 3 shows the nozzles in such an orientation that the exit of jet 8, particularly when seen in the direction of withdrawal of core 1, is in each instance positioned behind axis 6 of oscillating system B. This feature provides the respective dye-jet 8 with a transverse supplemental speed component that is effective in the direction of withdrawal of core 1. This direction is indicated by arrow 2. A particular variant is possible according to which the nozzle body component that extends along the core is rearwardly directed. In the construction and orientation of FIG. 3 the curvature of the jet is in the direction of strand movement. If the nozzle in FIG. 3 were so to speak to the left of axis 6, then the concave side of the curvature would face the direction of strand movement. Such a construction may lead to a closer physical proximity of oscillation systems A and B. However one still prefers the configuration shown in FIGS. 2 and 3 because here the velocity component imparted by the operation to dye-jet 8 is effectively in the direction of withdrawal of core 1 and not opposite thereto.

The invention is not limited to the embodiments described above but all changes and modifications thereof, not constituting departures from the spirit and scope of the invention, are intended to be included.

I claim:

1. Apparatus for the continuous marking of elongated stock moving in the direction of extension of the stock and including nozzle means for directing a dye-jet towards the elongated stock, the improvement comprising;

means connected to the nozzle means for causing the nozzle means to oscillate on a plane parallel to the direction of movement of the elongated stock to be marked; and means included in the nozzle means for orienting the jet as produced by and in the nozzle means so that the jet flows in the nozzle means along said plane of oscillation and is redirected to emerge at right angles to the plane of oscillation as provided by said means for oscillating so that the jet impinges upon the stock to be marked at right angles.

2. Apparatus as in claim 1 wherein said nozzle includes a first duct extending in the nozzle body in a particular direction and being continued in a second duct extending at 90 degrees to the first duct and including the operning for directing the dye-jet toward said stock.

3. Apparatus as in claim 1, said nozzle means being a tube of L-shaped configuration.

4. Apparatus for the continuous marking of elongated stock moving in the direction of extension of the stock, comprising;

nozzle means for directing a dye-jet towards the elongated stock;

means connected to the nozzle means for causing the nozzle means to oscillate in a plane parallel to the direction of movement of the elongated stock to be marked; and duct means included in the nozzle means for orienting the jet as produced by and in the nozzle means so that the jet flows in the nozzle means along said plane of oscillation and is redirected to emerge at right angles to the plane of oscillation as provided by said means for oscillating so that the jet impinges upon the stock to be marked at right angles.

5. Apparatus as in claim 4 wherein said duct means includes a first duct extending in the nozzle body in a particular direction and being continued in a second duct extending at 90 degrees to the first duct and including the operning for directing the dye-jet toward said stock.

6. Apparatus as in claim 4, said nozzle means being a tube of L-shaped configuration, the duct memos being the interior of the tube.

* * * * *